US005830054A

United States Patent [19]

Petri

[11] Patent Number: 5,830,054

[45] Date of Patent: Nov. 3, 1998

[54] COIN HANDLING SYSTEM

[75] Inventor: Bernd Petri, Oftersheim, Germany

[73] Assignee: Standardwerk Eugen Reis GmbH, Bruchsal, Germany

[21] Appl. No.: 639,634

[22] Filed: Apr. 29, 1996

[30] Foreign Application Priority Data

May 2, 1995 [DE] Germany ..... 195 17 303.1

[51] Int. Cl.[6] ..... G07D 3/14

[52] U.S. Cl. ..... 453/5; 221/281

[58] Field of Search ..... 453/3, 4, 5, 7, 453/9, 11, 15, 17, 18, 21, 41; 221/281; 194/350

[56] References Cited

U.S. PATENT DOCUMENTS 782,430 2/1905 Tone ..... 221/281 X
4,374,529 2/1983 Kobayashi et al. ..... 453/41 X
5,059,153 10/1991 Goi ..... 453/11
5,064,404 11/1991 Champion ..... 453/17

FOREIGN PATENT DOCUMENTS 0 563 395 A1 10/1992 European Pat. Off. .
21 43 915 3/1973 Germany .
33 08 674 9/1984 Germany .

*Primary Examiner*—F. J. Bartuska
*Attorney, Agent, or Firm*—Baker & Daniels

[57] ABSTRACT

A coin handling system having a coin sorting system which singularizes, counts and sorts coins or similar disk-shaped objects and has a plurality of sorting outlets in combination with a coin safe which features a plurality of coin bins. The coin bins are each associated with one coin sorting outlet and have a coin-specific dispensing unit. The coin dispensing units of each coin bin are connected to a spatial distribution unit which enables the dispensing of a predetermined number of a specific coin type to be fed to one of a plurality of coin compartments located on a coin cassette.

4 Claims, 2 Drawing Sheets

COIN HANDLING SYSTEM

BACKGROUND OF THE INVENTION

1. Field of the Invention

The present invention relates to coin handling systems.

2. Description of the Related Art

Coin handling, which occurs at monetary institutions, transit facilities, supermarkets and similar locations, and all of the coin handling details, such as deposit/withdrawal, detection/sorting, counting, packaging, receiving/delivery, checking, packaging and hauling, is generally an expensive operation in terms of both personnel requirements and expense.

In recent years, as for example in the Federal Republic of Germany, cash handling, including coin handling, has largely shifted from the above-listed institutions to facilities which specialize in money handling. The Central Banks have favored the out-sourcing of coin handling by shipping wrapped, instead of bagged coins. But it is unclear whether these changes have resulted in any cost savings. Notably, the out-sourcing of coin handling requires the shipment of the entire coin quantity to the processing facilities and subsequent shipment back, which adds to the expense of coin handling without providing any functional benefits.

More recently, units have appeared on the market which enable coin deposits of any kind (e.g., banks, cash reporting at transit facilities, etc.) as a quasi self-service procedure. This not only mechanizes the coin handling process but also streamlines the administrative work, such as posting, preparing statistics and vouchers, etc.

Supplying coins is particularly intense in terms of the paperwork, personnel and expense required wherever coins must be made available as ready cash, e.g., the distribution of coins to cash registers. Presently, the required coins are delivered by money handling facilities, handed over, checked by the store manager with subsequent safekeeping, and finally distributed to the cash registers. At store closing time, the coins are transferred from the registers to the store manager with proper accounting. A similar procedure takes place in the opposite direction prior to store, or register, opening. Of course, similar coin handling is also carried out at the cash registers during business hours.

The expenses associated with the above activities, including direct costs, such as delivery of wrapped coins, as well as overhead costs, such as administrative and payroll expenses, are quite considerable. A medium size chain store incurs about DM 80.00 weekly in direct costs and approximately DM 100.00 per cash register per week in overhead expenses. This amounts to costs of approximately 18 to 25 million DM annually for a supermarket chain with about 2,000 to 2,500 stores. Reduction of these costs suggests itself with priority.

The reduction of coin handling costs can be achieved by adherence to the following sequence:

- coins, sorted by denomination, are delivered in bags (not as wrapped coins) by the Central Bank, at no cost;
- the coin bags (with coin quantities and quality guaranteed by the distributing entity, e.g., Central Bank or mint) are emptied directly into coin bins and simultaneously recorded off-line;
- the coin bins dispense the coins to the individual cash registers in a self-service manner via integrated dispensing units;
- the dispensing of coins takes place without additional administrative or supervisory work;

- "ready-cash" coins are returned, at the store or register closing, by self-service to the overall unit, with no administrative or supervisory involvement (similarly, registers can be "audited" quickly and by self-service at any time in the interim);
- the time required for depositing and dispensing coins must be short;
- the safety of coin bins must be guaranteed in accordance with appropriate policies and requirements;
- all of the data must be recorded off-line, or on-line retrieval and processing must be allowed, and all of the self-service transactions must be documented for auditing purposes.

Known from EP 0 563 395 A1 is a "coin-depositing and coin-dispensing unit," which discloses an extremely complex, and thus very expensive, unit. This unit includes in combination all of the coin-handling/coin-processing methods known to date, such as singularization, detection, segregation, sorting, transport and dispensing. Although suited for use as a "window aid" and for "customer self-service," the unit disclosed by EP 0 563 395 A1 has several disadvantages:

- the unit is very complex, contains a large number of moving parts and its mechanical and electronic requirements are very expensive;
- based on its overall function, the unit contains many redundant components;
- the individual coins travel extremely long paths, resulting in expensive handling costs;
- the coins are dispensed singularly and in succession, and thus, in a relatively time-consuming fashion, especially for larger quantities;
- the coins constituting a desired sum are dispensed in a coin mix based upon a calculation which miminimizes the total number of coins;
- the procedure is based generally upon an expensive direct measurement, with sensors, of the coin quantity in the bins;
- simultaneous deposit and dispensation of coins is not possible.

SUMMARY OF THE INVENTION

The objective underlying the present invention is to provide a system for handling, i.e., sorting, counting, dispensation and combinations thereof, of coins or similar disk-shaped objects which allows universal use with relatively simple means and a relatively simple structural concept. By universal use, it is meant that the system can be used as a unit for depositing, sorting, counting, dispensing and cassette filling.

This objective is accomplished by the combination of a coin sorting system which singularizes, counts and sorts coins according to their denomination. The coins are routed to a plurality of outlets wherein each outlet leads to a separate coin bin. Each of the coin bins has a dispensing unit for dispensing a predetermined quantity of a single denomination of coins from the bin to a spatial distribution unit. The spatial distribution unit feeds the coins to a coin compartment located on a coin cassette. The coin cassette, which has a plurality of coin compartments, thereby has a predetermined number of coins of a single denomination dispensed to individual coin compartments located thereon.

The coin handling system according to the invention is based on a known coin sorting system combined with previously known bins which receive a single denomination of coin sorted from an assortment of coins. Manufactured by the applicant for years, this coin sorting system is based on an electromagnetic detection system (Reis Coin Detection System or "RCDS") which checks coins for genuineness, quality and value. Foreign and damaged coins are segregated and the remaining genuine coins are transported along a sorting track where they are sorted into individual coin bins. The coin bins have an inner "geometry" such that a coin dispensing unit at the bottom of the bin is capable, despite the relatively heavy coin weight (with a full bin), of dispensing the coins individually. The coin dispensing units are followed by a coin deflection system which spatially distributes the coins, sorted by denomination and counted, to an appropriate coin cassette in a handling-friendly and user-friendly manner (notably in keeping with a statistical distribution key).

The coin bins may be filled and emptied in more than one manner. For one, the coin bins can be tilted forward individually and directly filled with a preset quantity of coins from a bag. For another, they may be filled by feeding a heterogeneous and uncounted mix of coins in the functionally preassigned coin detection and sorting system. A third option is filling the coin bins (for example, to check for foreign, false, sound but off-denomination damaged coins) via the detection and sorting system using bags containing a coin mix consisting of presorted coin denominations.

There are two basic variants for emptying the coin bins. For one, the coins contained in the bins can be dispensed via their integrated dispensing unit, which allows very specific preset coin assortments to be dispensed. Additionally, it is possible to tilt the coin bins about a pivot axle and empty them via their hopper. This method of emptying the bins is important in case of technical defects and for service and maintenance purposes.

It goes without saying that all procedures are controlled electronically and that all quantity, value, transaction, user and similar data, as well as statistical information, is recorded. The various transactions can be processed on-line or off-line and via different mediums. An essential characteristic of the present handling system for coins and similar items is that the operation of the unit, as well as audits and similar functions, can be performed only and exclusively via an appropriate "authorization key," a so-called coding pin. Of course, all of the access/intervention procedures and pertaining data is recorded.

More generally, the coin bins may be viewed as integrated coin safes, so that the coins may remain on deposit overnight. A computer configured as an operating unit with a peripheral printer allows, in addition to the relevant activation and sequence control of the modules for coin handling setup, including access control via the coding pin, the electronic calculation, retrieval and saving of references on coin quantities in the various bins at any time via associated criteria, such as "full" or "empty". The coin quantities are determined by the coin count and thus without direct sensor measurements.

BRIEF DESCRIPTION OF THE DRAWINGS

The invention is more fully explained hereafter with the aid of the drawing, wherein.

DESCRIPTION OF THE PRESENT INVENTION

Figure 2:
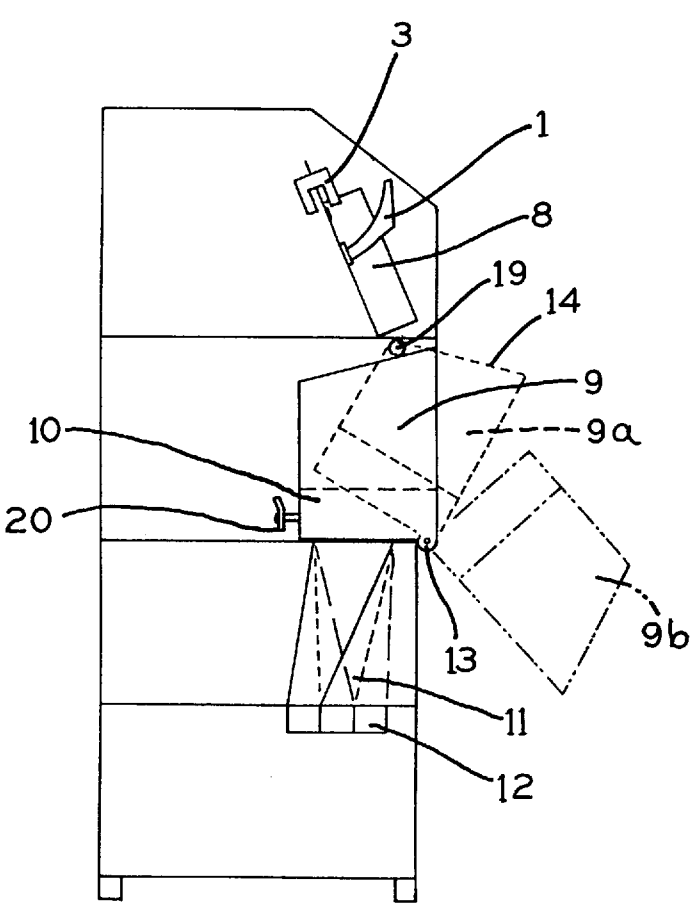
FIG. 2 is a view of the handling system according to FIG. 1 in side elevation.
Figure 1:
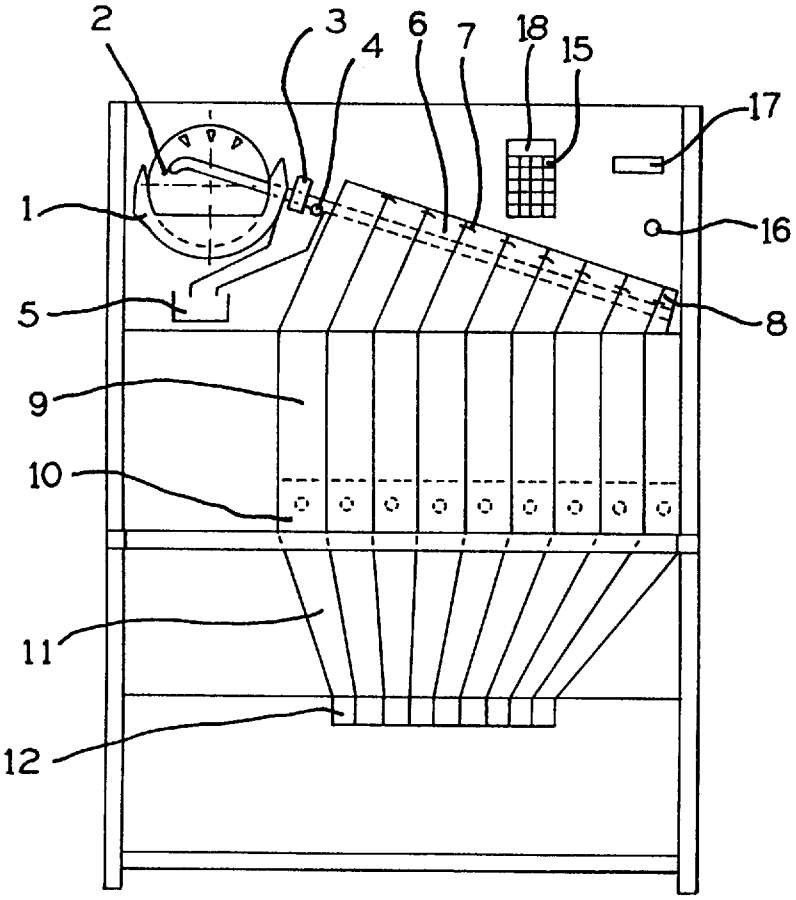
FIG. 1 is a schematic illustration of the coin handling system in front elevation.

The coin handling system illustrated in FIGS. 1 and 2 consists of three units that are functionally adapted and coupled to one another, the coin counting and sorting system, the coin bin with pertaining dispensing unit, and the coin distribution system (coin manifold) with follow-on coin cassette. This is combined with a complex data processing system for control of the entire operating sequence of the coin handling system. The data processing system and the aforementioned modules only allow activation when an operator "enables" the handling system as a whole via a person-specific or responsibility-specific coding input.

Coin loading, as unsorted mix or by specific denominations, takes place via a coin caddy 1. A rotating drive disk (coin tray) 2 feeds the coins individually and successively on a sorting track 6 for passage through a coin detection and counting sensor 3. The coin detection and counting sensor 3 checks the coins one by one for genuineness, their value and quality. Coins recognized as false, foreign or damaged are shunted off the sorting track 6 by a segregating magnet 4 and proceed to a foreign coin release 5. Accepted coins undergo sorting on the sorting track by means of coin deflectors (switches) according to their diameter. The coins proceed in this fashion via a coin shaft 8 to specifically assigned coin bins 9. In addition to the coin detection and counting sensor 3 there is an electronics array which sums the quantity of coins directed to the respective bin 9.

Figure 3:
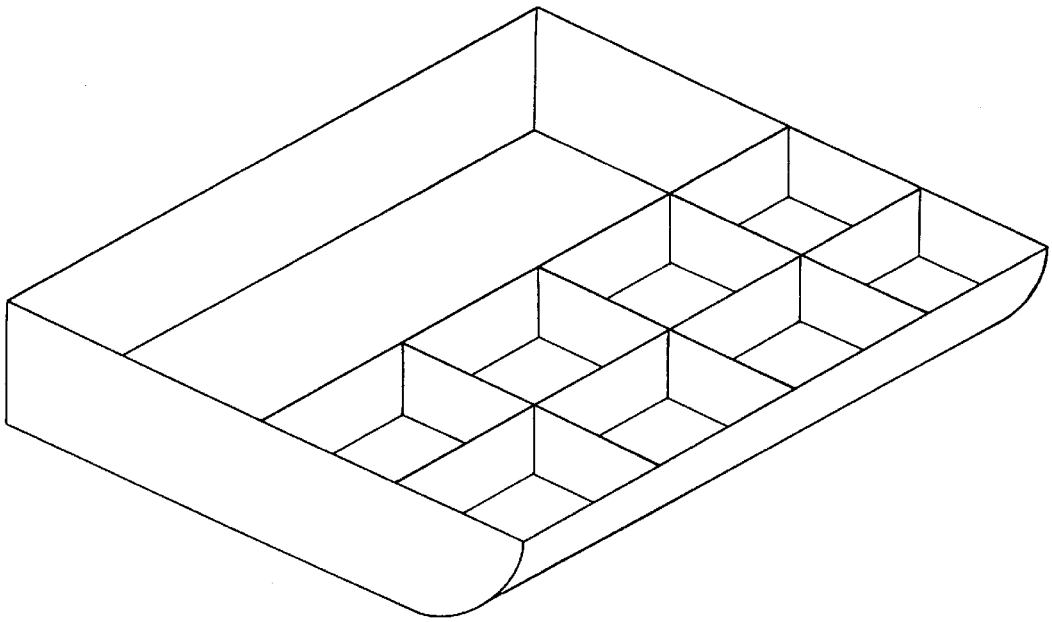
FIG. 3 is a perspective view of an exemplary embodiment of a coin cassette.

A coin dispensing unit 10 dispenses the coins in a defined manner and in a predetermined number. The coins then proceed via a distribution unit (or coin manifold) 11, to a compartment of a coin cassette 12 (FIG. 3). To safeguard the reliable transfer of coins from the dispensing unit 10 to the cassette 12, the engineering of the dispensing units 10 is such that they are relieved of the high pressure of the coin column in the coin dispensing unit 10. The control electronics array subtracts the dispensed coin quantity from the respective bin 9 and is able to determine and document at any time the current coin inventory in the coin bins 9.

The coin handling system may be filled with coins without using the sorting system described above by tilting the coin bin 9 on a pivot axle 13 to a position 9*a*, latching it in a catch 19 and using presorted and exactly counted coins. In this manner, coins can be loaded directly into the coin bin 9. To update the coin inventory of the respective bin 9, the coin amount loaded, or replenished, must be entered via keyboard 15 and the electronic control which form an integral part of the data processing system.

The coin bin(s) 9 may be completely emptied for auditing or servicing by tilting the bin on the pivot axle 13 to a position 9*b*. In this position, the coins can be removed in their entirety by way of the hopper 14.

The filling and dispensing procedures of the system are initiated via the keyboard 15, the individual transactions and sequences being shown in menu dialog via display 18 which is integrated in the data processing system. The identification key 16 required for activation of the central coding input, allows the specific assignment of authorizations for operation of the handling system. For example, identification key 16 may be restricted so as to allow deposits only via the sorting system; or only the withdrawal of a standard mix of coins (via coin cassette 12); or only to fill the coin bins from bags. Somebody needs to be authorized also, of course, to intervene in the programming of the overall system. In the case of bag filling authorization, a latch 20 of the bin 9 is enabled upon selection of this procedure to provide this access.

All of the access and intervention procedures relative to the inventional handling system are stored and at the same time coordinated with the current identification key 16 by the electronics integrated in the data processing system. To obtain a printout of the completed transactions, fill levels, statistics, authorizations and reports, the data processing system features a peripheral printer 17.

With reference to FIG. 3, the distribution unit between coin bins 9 and coin cassette 12 shall be addressed. The objective to be accomplished with the present handling system includes making a defined coin mix available in a coin cassette 12. To that end, each coin bin 9 is, via a tubular coin line, coupled to a compartment of the coin cassette 12. This makes it possible to feed, in response to an appropriate request, the quantity of individual coins, preset on grounds of statistical data, by way of said coin lines to each compartment.

LIST OF REFERENCES

1 Coin caddy
2 Coin tray
3 Coin authenticator
4 Segregating magnet
5 Foreign coin release
6 Sorting track
7 Coin deflector
8 Coin shaft
9 Coin bin
10 Coin dispenser
11 Coin manifold
12 Coin cassette
13 Pivot axle
14 Hopper
15 Keyboard
16 Identification key
17 Printer
18 Display
19 Catch
20 Latch While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A system for handling coins and similar disk-shaped objects comprising:

a coin sorting apparatus which singularizes, counts and sorts coins, said coin sorting apparatus having a plurality of sorting outlets, each of said outlets being associated with a single denomination of coin; and a coin safe having a plurality of coin bins adapted to contain a plurality of unstacked coins, each of said coin bins being adapted to receive coins from only one of said sorting outlets; each of said coin bins capable of receiving coins alternatively from said sorting apparatus and from a source of coins external to said sorting apparatus; each of said coin bins being tiltable to a position while attached to said safe to thereby empty the bin of coins; each of said coin bins having a dispensing unit for dispensing predetermined quantities of a single denomination of coin; each of said dispensing units being operatively connected with a spatial distribution unit whereby said dispensing units may each dispense a predetermined number of coins of a single denomination to one of a plurality of coin compartments located on a coin cassette.

2. A coin handling system according to claim 1, wherein each of said coin bins is individually swingable into a first position which is adapted for the placing of coins into said coin bin, and a second position which is adapted for the removal of coins from said coin bin.

3. A coin handling system according to claim 2, further comprising a central coding input which locks and unlocks one of said coin cassette and said plurality of coin bins.

4. A coin handling system according to claim 1, further comprising a central coding input which locks and unlocks one of said coin cassette and said plurality of coin bins.

* * * * *

UNITED STATES PATENT AND TRADEMARK OFFICE

CERTIFICATE OF CORRECTION

PATENT NO. : 5,830,054
DATED : November 3, 1998
INVENTOR(S) : Bernd Petri

It is certified that error appears in the above-identified patent and that said Letters Patent is hereby corrected as shown below:

Title page,
[73] Assignee: after "GMBH" insert -- & CO. --

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*